US005365999A

United States Patent [19]

Stummer et al.

[11] Patent Number: 5,365,999

[45] Date of Patent: Nov. 22, 1994

[54] METHOD FOR THE PROCESS CONTROL OF A PRESSURE DIECASTING MACHINE AND AN APPARATUS FOR CARRYING OUT THE METHOD

[75] Inventors: Friedrich Stummer, Fellbach; Rolf Frey, Winterbach; Albert Reinhardt, Berg; Wolfgang Lutz, Kernen, all of Germany

[73] Assignee: Maschinenfabrik Mueller-Weingarten AG, Weingarten, Germany

[21] Appl. No.: 58,254

[22] Filed: May 10, 1993

[30] Foreign Application Priority Data

Jun. 5, 1992 [DE] Germany ..... 4218556

[51] Int. Cl.[5] ..... B22D 17/32

[52] U.S. Cl. ..... 164/457; 164/113; 164/312; 164/155.4; 164/155.5

[58] Field of Search ..... 164/457, 155, 151, 150, 164/4.1, 154, 113, 312

[56] References Cited

U.S. PATENT DOCUMENTS

| | | | |
|---|---|---|---|
| 3,731,727 | 5/1973 | Mitamura et al. | 164/154 |
| 4,011,902 | 3/1977 | Koch et al. | 164/113 |
| 4,330,026 | 5/1982 | Fink | 164/457 |
| 4,559,991 | 12/1985 | Motomura et al. . | |
| 4,629,954 | 12/1986 | Banzai et al. | 318/561 |
| 4,858,103 | 8/1989 | Takeuchi et al. | 364/174 |
| 5,052,909 | 10/1991 | Hertzer et al. | 425/150 |
| 5,207,267 | 5/1993 | Iwamoto et al. | 164/154 |

FOREIGN PATENT DOCUMENTS

| | | | |
|---|---|---|---|
| 0065841 | 12/1982 | European Pat. Off. . | |
| 2021182 | 11/1971 | Germany . | |
| 2806051 | 8/1978 | Germany . | |
| 2801829 | 7/1979 | Germany | 164/155 |
| 3209834 | 9/1982 | Germany . | |
| 3329705 | 3/1985 | Germany . | |
| 3203683 | 1/1991 | Germany . | |
| 0562380 | 9/1977 | U.S.S.R. | 164/154 |
| 0900965 | 1/1982 | U.S.S.R. | 164/155 |

OTHER PUBLICATIONS

Patent Abstracts of Japan, vol. 14, No. 379 (M-1012), Aug. 16, 1990, JP-A-2142664 of May 31, 1990.

Patent Abstracts of Japan, vol. 10, No. 353 (M-539), Dec. 24, 1984, JP-A-61150764 of Jul. 9, 1986.

Ernst Brunnhuber, "Praxis der Druckguss fertigung", (Pressure Diecasting Production Practice), 3rd edition, 1980, pp. 70-78.

Friedrich Klein, "Automatische Giess prozess überwachung bein Druckgiess en" (Automatic Casting Process Monitoring in Pressure Diecasting), *Giess erei 68*, No. 18, 1981, p. 531.

H. Ebertshäuser, *Fluidtechnik von A bis Z*, Feb. 20th, 1992, pp. 252, 253, 304 and 305.

*Primary Examiner*—P. Austin Bradley
*Assistant Examiner*—Erik R. Puknys
*Attorney, Agent, or Firm*—Spencer, Frank & Schneider

[57] ABSTRACT

A method for the process control of a pressure diecasting machine, consisting of casting equipment (2) and a casting drive system (1), and an apparatus for carrying out the method are proposed. In order to regulate the movements both of the ram or drive plunger (8) in the pressing cylinder (7) and of the multiplier plunger (17) in the multiplier device (15) in each phase of the casting process, stepless devices (30, 31) measuring displacement and speed to determine the position or movements and also quick-adjustment servo-proportional valves (33 to 36) to regulate the movement both of the ram (8) and of the multiplier plunger (17) are provided.

14 Claims, 4 Drawing Sheets

Figure 1:
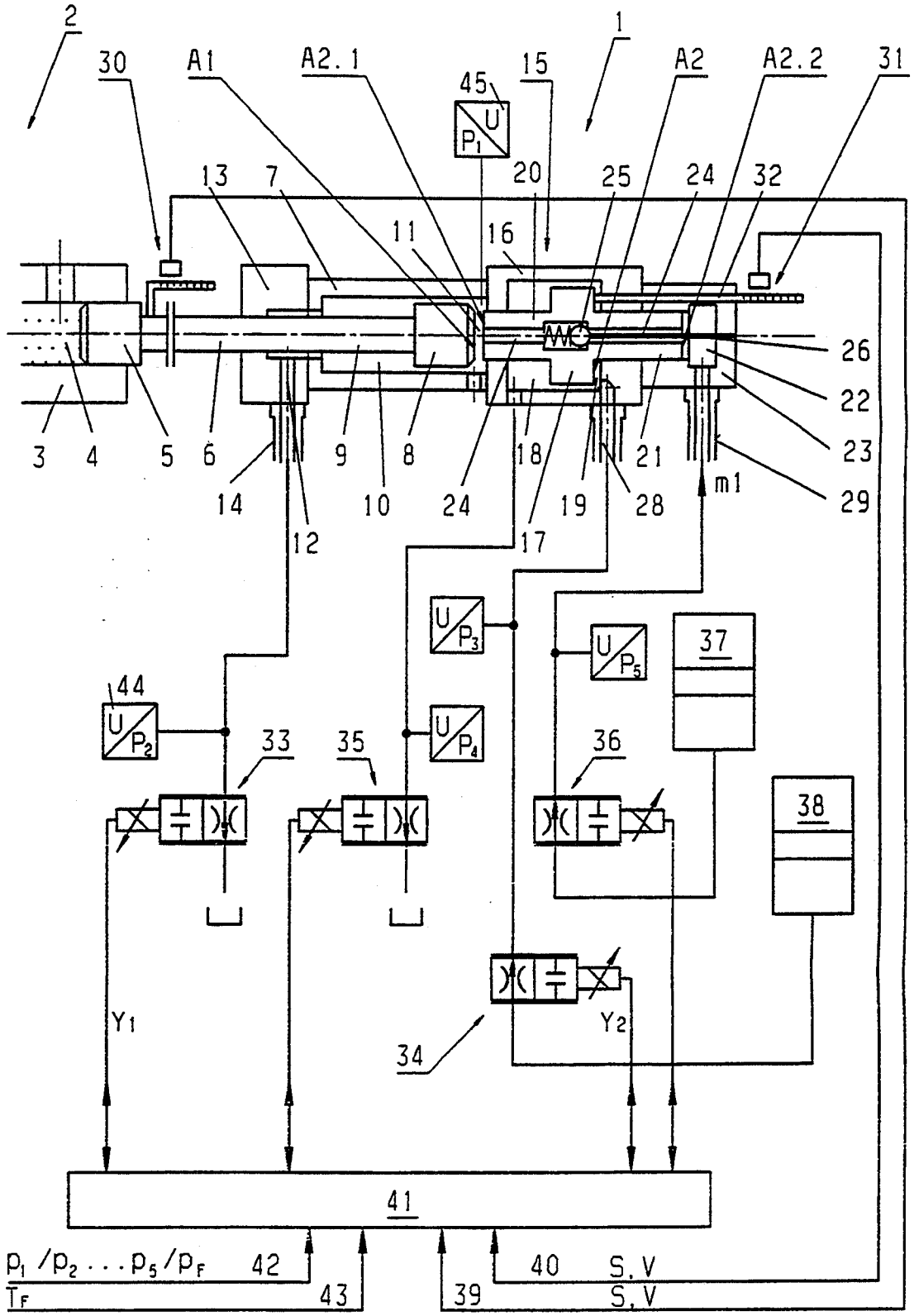

METHOD FOR THE PROCESS CONTROL OF A PRESSURE DIECASTING MACHINE AND AN APPARATUS FOR CARRYING OUT THE METHOD

The invention relates to a method for the process control of a pressure diecasting machine, and to an apparatus for carrying out the method.

From the Applicant's German Patent Specification 20 21 182 an apparatus is known for adjusting the ram speeds and pressures in pressure diecasting machines working in accordance with the so-called three-phase system in cold-chamber pressure diecasting machines. This type of operation is used for adjusting the different ram speeds and pressures required in pressure diecasting, wherein in the first and second working phases only the pressing cylinder ram acting on the injection plunger is loaded via pressure medium lines, and during the third working phase a multiplier plunger in the form of a stepped plunger is loaded. In this known arrangement the ram is loaded with pressure medium in the first and second working phases via a bore provided with a non-return valve in the multiplier plunger. Because of the increasing pressure in the pressing cylinder chamber, the bore in the multiplier plunger is closed, so that during the third phase (dwell phase) the multiplier plunger acts with its plunger surface transmission ratio on the ram and thus on the injection plunger.

"Three-phase system" is accordingly understood as meaning the performance of the casting process, particularly in a horizontal cold-chamber pressure diecasting machine, with a casting chamber prefilling phase (first phase), a casting die filling phase (second phase), and a casting die dwell phase (third phase).

The known apparatus according to German Patent Specification 20 21 182 is in addition referred to as a two-circuit casting unit, because in the first circuit, during the first and second working phases, the ram, and in the second circuit, during the third working phase, the multiplier plunger is loaded, with pressure medium from different plunger reservoirs. In the known apparatus the multiplier plunger in this arrangement is constructed with a plunger rod provided on both sides of the plunger, so that for the purpose of pressurizing the multiplier plunger a front annular surface is formed on the multiplier plunger itself and another annular surface is formed on the rear plunger rod. This provides the advantage that separate regulation of the annular pressure chamber on the multiplier plunger and of the additional rear cylinder chamber behind the plunger rod is made possible. For the regulation of these pressure chambers throughflow valves are provided, which are mounted by displacement transducers on the rod of the ram or on the injection plunger rod connected thereto. In this arrangement, with the aid of the valve control system the rear cylinder chamber behind the rear multiplier plunger rod is first loaded with pressure medium, which passes via the central bore to the cylinder chamber of the pressing cylinder and thus to the ram (first and second working phases). During the third working phase (dwell phase) another throughflow valve is opened by means of a displacement transducer or by pressure-dependent switching in order to load the annular cylinder chamber of the multiplier plunger and the rear cylinder chamber with pressure medium, the central bore in the multiplier plunger being automatically closed when the pressure rises.

In this known apparatus the pressure medium in front of the ram is forced out through an outlet bore into an oil reservoir during the first and second working phases without special regulation and pressure control, and is allowed to re-enter on the return movement of the ram. The pressure medium in front of the multiplier plunger in the cylinder chamber of the multiplier is likewise delivered, via a throttle valve, into an oil reservoir on the forward movement of said multiplier plunger in the third working phase (dwell phase), and on the return movement of the multiplier plunger is correspondingly pumped back into said chamber. Regulation and control of the ram and multiplier plunger in the known apparatus are therefore effected exclusively through the timing of the feeding of the pressure medium to the individual pressure chambers in the pressing cylinder and in the multiplier cylinder and to the rear cylinder chamber respectively, while additional throttle valves permit a certain flow regulation through a pressure drop. No other action on the control is provided because of the lack of regulation facilities.

From the publication: Ernst Brunnhuber, "Praxis der Druckguβfertigung" (Pressure Diecasting Production Practice), 3rd edition, 1980, multiplier arrangements are also known, which are explained in detail on pp. 70 to 78. In particular on pp. 73 and 75 multiplier arrangements on a casting drive are shown, by means of which it is also possible to work with a three-phase system. In this case the pressure reservoir is likewise brought into action for the dwell phase by means of an impulse from the injection plunger through the opening of a shot valve. In the description on page 75 of this publication an additional regulation of the multiplier pressure by means of a counterpressure supplied by another pressure reservoir is moreover proposed, whereby the forward movement of the multiplier plunger is braked and pressure peaks are thus avoided. Regulation of the pressure build-up time in the third working phase can thereby be achieved to a certain extent. According to this publication pressure rise times through the pressure reservoirs of about 10 ms or less are achieved. A corresponding pressure/time diagram is given as explanation on page 77 of the Brunnhuber publication.

In one embodiment according to the description given on page 78 of the Brunnhuber publication, a through bore in the multiplier plunger is dispensed with and the pressurization of the ram is effected directly in the cylinder chamber lying behind it. In this case a first pressure reservoir acts directly on the cylinder chamber of the ram, which is also known as the drive plunger. A second pressure reservoir acts on the multiplier plunger by means of the corresponding impulse.

In addition to the literature sources mentioned, numerous publications are known which deal with process control both in injection molding and in pressure diecasting. The publication: Klein, "Automatische Gieβprozeβüberwachung beim Druckgieβen" (Automatic Casting Process Monitoring in Pressure Diecasting), Gieβerei 68, (1981), No. 18, pp. 531 et seq., in particular, discloses a casting process control system of this kind in which a multiplicity of paramaters, such as mold filling time, pressure build-up time, bath pressure, mold fill factor, bath temperature, and so on, are read as actual values and compared with preset desired values. In the event of poor quality of the product, the actual values and optionally also the desired values are corrected in order to achieve an improvement of the results obtained in subsequent casting operations. The casting conditions are accordingly monitored during the pressure diecasting process and if required corrected for subsequent casting processes.

All known casting process monitoring methods have the disadvantage that the casting parameters read during the casting process cannot act directly on the casting process taking place at the time, since no provision is made for feedback of casting parameters read.

The problem underlying the invention is that of providing an improved method of casting process monitoring, particularly for the process control of a pressure diecasting machine, and to a corresponding apparatus for carrying out the method.

The method according to the invention and the corresponding apparatus for carrying out the method have the advantage over the known prior art that a so-called real-time controlled two-circuit casting apparatus is produced, with which direct action on the casting parmeters during the casting process is made possible. This is achieved in particular through the fact that the movement of the ram, or drive plunger for the injection plunger, can take place while being monitored and regulated in each phase of its movement. The same applies to the movement of the multiplier plunger during its movement in the third working phase. The ram or drive plunger in the appertaining pressing cylinder and the multiplier plunger in the appertaining multiplier cylinder chamber are, so to speak, "clamped" between a front and a rear adjustable pressure cushion, so that during the three-phase movement the respective plungers can be regulated, separately and in tune with one another, in their forward and also in their backward movement, both in respect of their speed and in respect of their acceleration behaviour. The cylinder chamber in front of the ram and in front of the multiplier plunger is thus used as a regulable pressure chamber, the regulation system known in this respect for multiplier plungers being improved in the sense that direct feedback of the controlled values can be achieved.

This regulation is made possible by the use of so-called servo-proportional control valves, which react extremely quickly, in the respective control circuits; these valves are also known as so-called "continuous valves".

The ability to regulate in this way enables pressure peaks at the end of the mold filling phase to be reduced or prevented both by braking the ram and if necessary reversing the movement of the multiplier plunger, these two movements being interdependent. The third working phase with the building-up of dwell pressure can also be carried out in an optimally short time by matching the movements of the two plungers, the regulation times being under 5 ms.

Any variation of the speed of the injection plunger can accordingly be made by control and regulation of the ram alone in the first and second working phases and of the multiplier plunger in the third working phase by matching the hydraulic flows to these two cylinder chambers, higher accelerations being possible than can be achieved with hydraulic medium supply from only one hydraulic medium reservoir.

Figure 2:
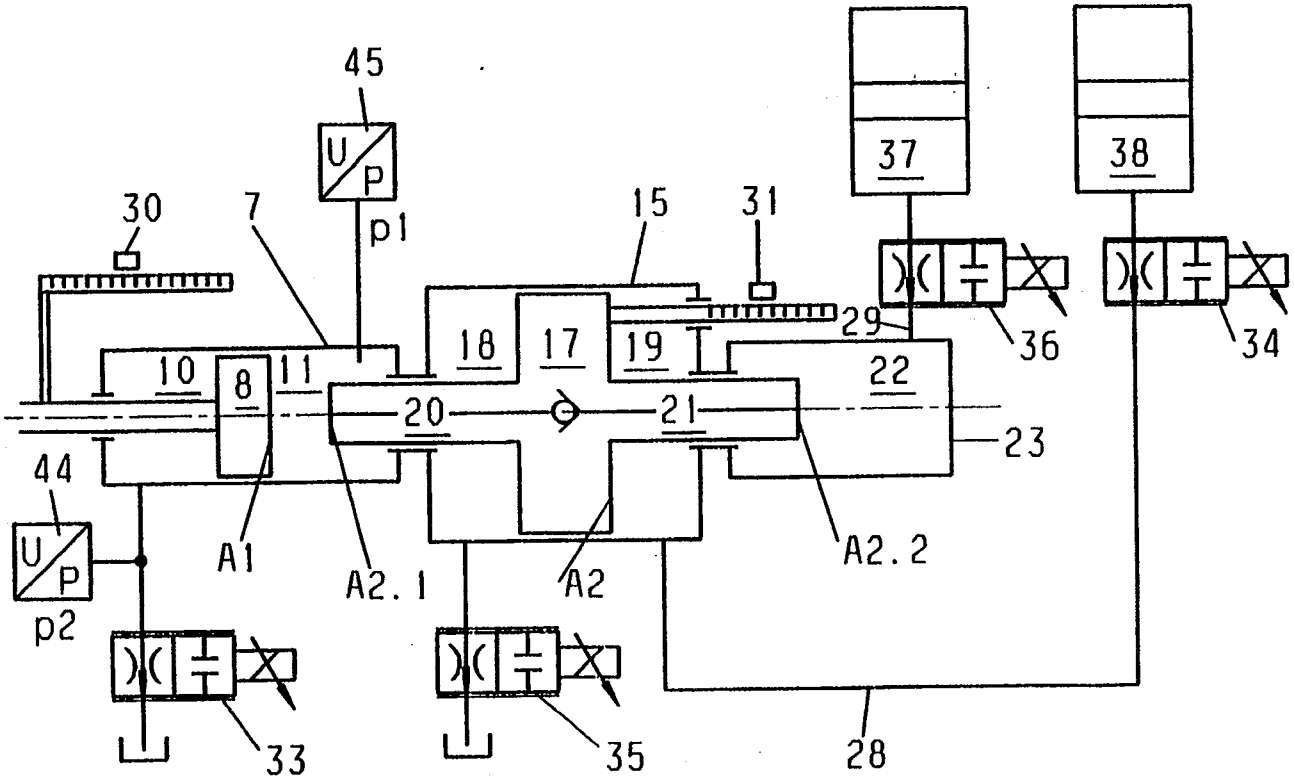
Figure 3:
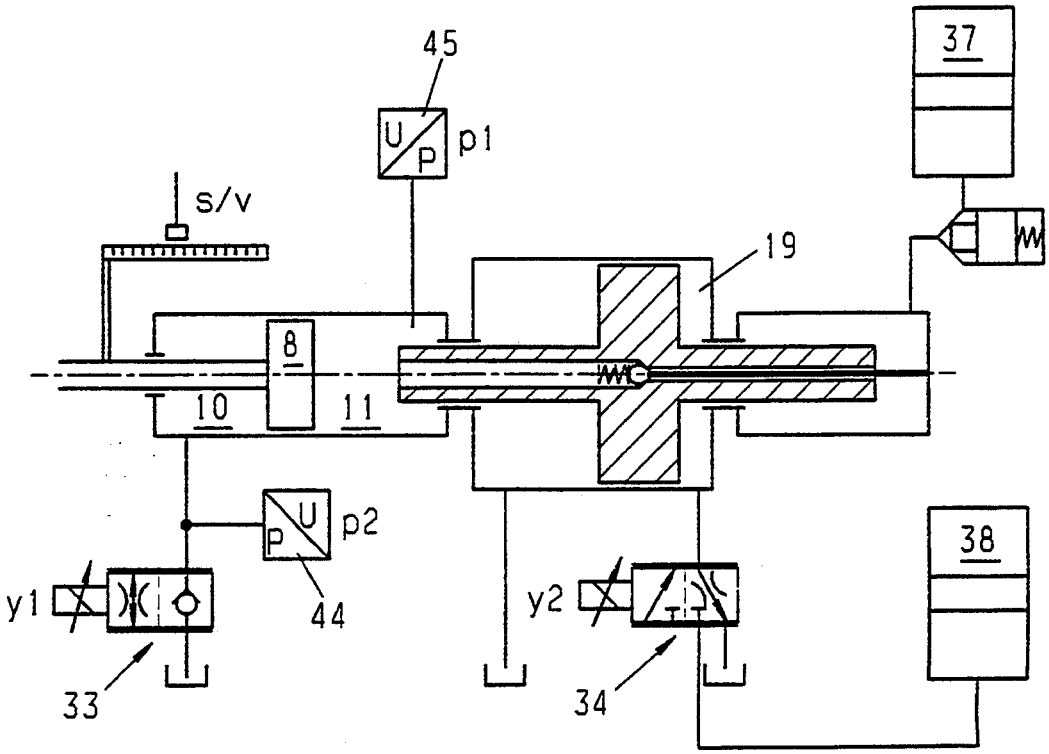
Figure 4:
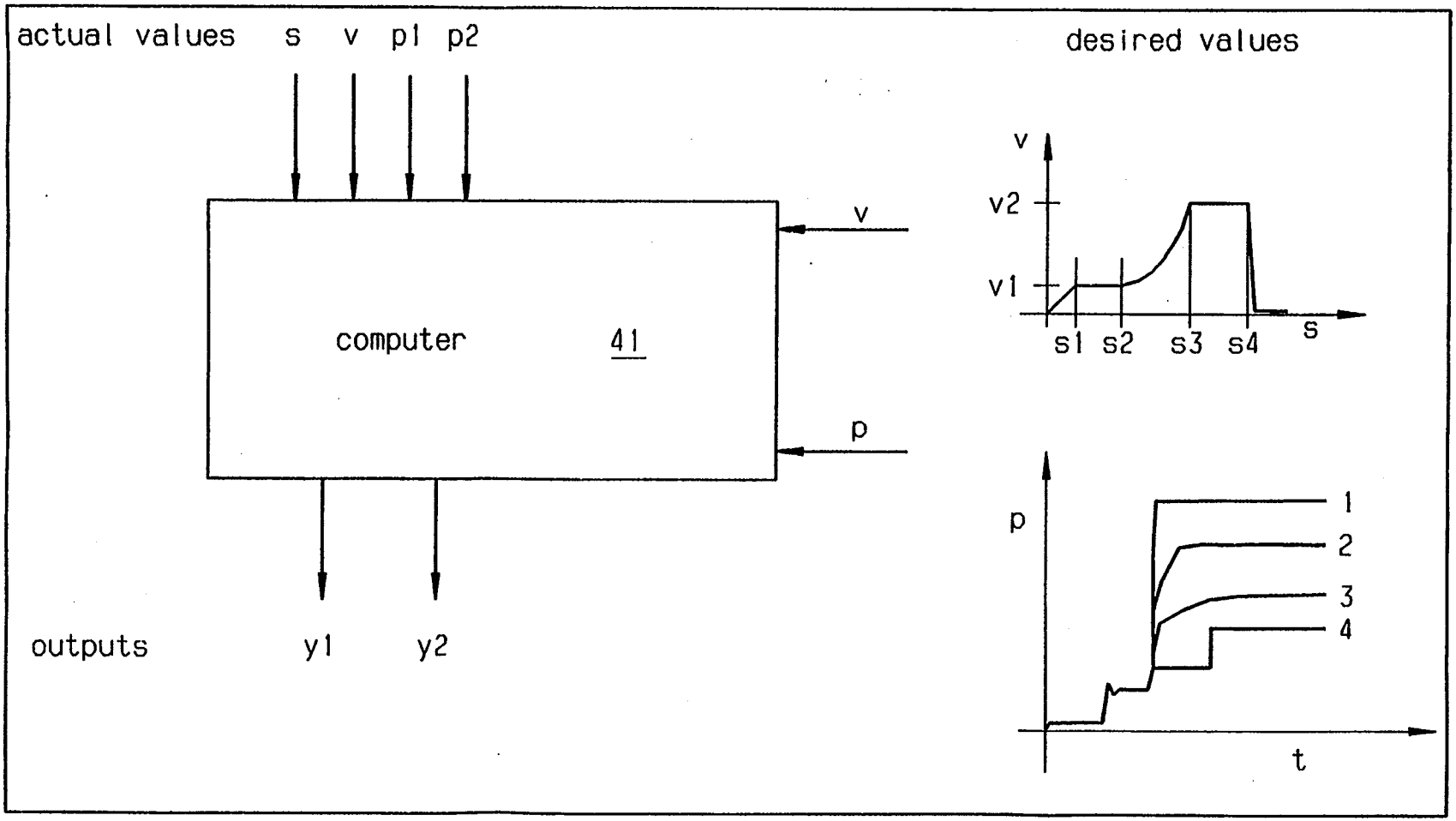

Further details and advantages of the invention are indicated in the following description of an example of embodiment of the invention. In the drawings:

FIG. 1 shows schematically an apparatus for carrying out the process control method according to the invention, FIG. 2 shows further details from FIG. 1, FIG. 3 shows a variant embodiment, and FIG. 4 shows a central computer with control function for the data to be processed.

DESCRIPTION OF THE INVENTION

The casting drive system 1 shown in FIG. 1 serves to operate casting equipment 2 consisting of a casting chamber 3 containing a metal bath 4 and of an injection plunger 5 for introducing the metal bath 4 into a mold cavity (not shown). The injection plunger 5 is connected by an injection plunger rod 6 to the casting drive system 1. The casting drive system 1 consists of a front pressing cylinder 7, in which is guided a ram 8 which serves as drive plunger 8 for the appertaining plunger rod 9. The plunger rod 9 is connected to the injection plunger rod 6. The pressing cylinder 7 comprises a front cylinder chamber 10 and a rear cylinder chamber 11, these two cylinder chambers being separated by the ram 8. The front cylinder chamber 10 is connected by a radial and then axial bore 12 in the cylinder head 13 to a pressure medium connection 14.

A multiplier device 15 adjoins the pressing cylinder 7 and consists of a closed multiplier cylinder casing 16 containing an axially slidable multiplier plunger 17, which divides the multiplier cylinder chamber into a closed front cylinder chamber 18 and a closed rear cylinder chamber 19. The multiplier plunger 17 comprises, in a manner known per se, a first plunger rod 20 which points forwards, that is to say towards the casting equipment 2, and which extends through the cylinder wall of the multiplier cylinder casing into the rear cylinder chamber 11 of the pressing cylinder 7. The multiplier plunger 17 also comprises a rear plunger rod 21, which likewise extends by way of the multiplier cylinder casing sideways into a rear cylinder chamber 22 of an additional connection casing 23. The multiplier plunger 17, with its front plunger rod 20 and rear plunger rod 21, has extending through it a central longitudinal bore 24 in which a nonreturn valve 25 is disposed. In the rearmost position of the multiplier plunger 17 the nonreturn valve 25 is pressed away from the valve seat, and thus opened, by means of a rod 26 passing through the longitudinal bore 24.

The rear cylinder chamber 19 of the multiplier cylinder can be loaded with pressure medium via the pressure medium connection 28, and the rear cylinder chamber 22 of the additional connection casing 23 can be loaded with pressure medium via the pressure medium connection 29.

Each position of the injection plunger rod 6 and of the plunger rod 9 is detected by means of a device 30 measuring displacement, speed and acceleration. The same applies to the measuring device 31 for detecting every position and the displacement, speed and acceleration of the multiplier plunger 17. For this purpose a slidable measuring rod 32 extends, parallel to the longitudinal axis, from the multiplier plunger 17 to the corresponding measuring device 30. The measuring device may for example be of the type described in DE 32 09 834 A1.

The basic construction of the casting drive system for the casting equipment is also described in the previously mentioned Patent Specification PS 20 21 182 of the Applicant. Express reference is hereby made to the entire contents of this patent specification, insofar as it is applicable to the present invention.

According to the invention, for the production of a real-time controlled two-circuit casting apparatus use is made of a series of quick-adjustment servo-proportional valves, also known as continuous valves. Through the use of at least two continuous valve assemblies 33, 34, and by matching the corresponding plunger surfaces $A_1$ of the ram 8 and the circular annular surface $A_2$ of the multiplier plunger 17, and also the circular surfaces $A_{2.1}$ of the front plunger rod 20 and $A_{2.2}$ of the rear plunger rod 21, the movement pattern of the casting drive system is coordinated. In FIG. 2 the basic construction and the arrangement of the casting drive system are shown again.

By means of p/U measuring transducers the pressure in the pressure chambers 10, 11 or 18, 19 or 22 can be detected and utilized as a regulation signal.

The servo-proportional valve 33 accordingly regulates the pressure conditions in the front cylinder chamber 10 (pressure $p_2$ at the measuring transducer 44) of the pressing cylinder 7 and effects a kind of clamping of the ram 8 between the pressure chamber 10 (pressure $p_2$) and the pressure chamber 11 (pressure $p_1$). This can be detected by means of the p/U transducer 45 and thus be regulated. The movement of the ram 8 can thus take place.

The servo-proportional valve 34 similarly effects regulation of the rear pressure chamber 19 of the multiplier plunger 17, the front pressure chamber 18 of the multiplier plunger preferably likewise being regulated by means of another servo-proportional valve 35. p/U measuring transducers (not shown) may also be associated with these continuous valves in order to detect and thus to regulate the pressure conditions in the pressure chambers 18, 19.

Finally, for the purpose of regulating the rear cylinder chamber 22 use is likewise made of regulation by means of a rapid-action servo-proportional valve 36 at the pressure medium connection 29, so that the pressurizing of the pressure chamber 22 can be effected with the aid of a first pressure reservoir 37 and that of the pressure chamber 19 with the aid of a second pressure reservoir 38, via a quick-action proportional valve control system. Here again additional p/U measuring transducers may be used.

By these means both the ram 8 and the multiplier plunger 17 can be "clamped" on both sides, so that a sensitive movement can be made in all axial directions, that is to say forwards and backwards. The casting drive system can be controlled or regulated by continuous determination of the position "s", the speed "v" or the acceleration of both the injection plunger rod 6 and the multiplier plunger 17 during the casting process, as is also illustrated in principle in the two diagrams $v=f(s)$, $p=f(t)$ in FIG. 4. The pressure in the individual pressure chambers serves once again as measured quantity. The appertaining measurement data from the measuring devices 30, 31 and the p/U measuring transducers 44, 45 and so on pass via measurement lines 39, 40 to a computer 44 (see FIGS. 1 and 4), in which the other casting parameters required are likewise collected and evaluated. The continuous valve assemblies or servo-proportional valves 33 to 36 are then operated by the computer 41, so that the movement pattern of the casting drive system can be monitored and regulated in each phase during the casting process. By means of appropriate additional pressure sensors in the mold cavity, for example, the pressure $P_F$ prevailing there or, by means of appropriate temperature sensors, the temperature $T_F$ of the bath prevailing there can be detected and passed via the control lines 42, 43 to the computer 41. Pressure peaks at the end of the mold filling phase can then be reduced or completely avoided both by braking the ram 8 and if necessary by reversal of the movement of the multiplier plunger 17, these movements being interdependent in each case. The build-up of dwell pressure can also be effected in an optimally short time by matching the movements of these two plungers, the regulation of the proportional valves 33 to 36 being effected in a time of less than 5 ms.

The speed variations of the ram 8 and hence of the injection plunger 5, for the purpose of controlling the casting speed, can be controlled by matching the amounts of hydraulic medium flowing to the pressing cylinder 7 in order to load the ram 8 and to the multiplier cylinder in order to load the multiplier plunger 17, higher accelerations of the two plungers being possible than can be achieved by supplying hydraulic medium from only one hydraulic medium reservoir. By virtue of the corresponding clamping of the two plungers every movement of the casting drive system is here monitored and controlled.

The plunger surfaces $A_{2.1}$ and $A_{2.2}$ in particular should be so designed that, for example in the forward movement of the multiplier plunger, the amount of medium flow for movement purposes at $A_{2.2}$, that is to say to the rear plunger rod of the multiplier plunger, will be in the ratio range of from 0.8 to 1.2:1 in relation to the amount of medium displaced at $A_{2.1}$. The circular cylinder area $A_1$ of the ram 8 to the sum of the areas $A_2+A_{2.2}$ will be in the ratio of 1:2.5 to 4. This proportioning of the areas permits optimum operation of the casting drive system.

In a simplified alternative example of embodiment illustrated in FIG. 3, only the front pressure chamber 10 of the pressing cylinder 7 and the rear pressure chamber 19 of the multiplier device 15 are regulated by means of the continuous valves 33, 34 shown. Here once again the detection of measured values for the "clamping" of the drive plunger 8 is effected with the aid of the two p/U measuring transducers 44, 45 through the detected actual value signals $p_1$, $p_2$, which give rise to correcting quantity signals $y_1$, $y_2$ at the output of the computer 41. The corresponding control functions are illustrated in FIG. 4.

The diagrams shown in FIG. 4 relate to desired value presettings for regulating the casting process.

The curves 1 to 4 shown in the p f(t) diagram represent examples for desired value presettings, in the form of the desired value of the pressure behavior p plotted against time t. These $p=f(t)$ pressure curves can be regulated during operation.

The same applies to the $v=f(s)$ diagram as desired value presetting of the injection plunger speed plotted against the injection plunger displacement. The values $s_1$ to $s_4$ represent particular points in the displacement of the injection plunger; a particular speed can be allocated to each displacement point. At the point $s_4$, for example, the injection plunger speed is braked to a residual speed shortly before completion of the filling of the mold. These procedures are also regulated during operation.

The invention is not restricted to the example of embodiment illustrated and described. On the contrary, it also includes all further developments and improvements of the apparatus according to the invention, and also of the method according to the invention, which are within the capacity of those versed in the art and within the scope of the principle of the invention.

We claim:

1. A pressure diecasting machine, comprising:

a casting chamber for a metal bath;

an injection plunger movably disposed within the casting chamber;

a pressing cylinder having a pressure chamber, disposed behind the casting chamber and provided with a ram for driving the injection plunger, the pressure chamber being divided by the ram so that there is a front pressure chamber in front of the ram;

a multiplier device having a multiplier plunger, a closed multiplier cylinder casing divided into front and first and second rear cylinder pressure chambers by the multiplier plunger, disposed behind the pressing cylinder, the multiplier plunger being guided therein, the multiplier plunger including an operative rear, circular annular pressure surface $A_2$ in the closed multiplier cylinder casing, a first, front plunger rod having an operative front pressure surface $A_{2.1}$ leading into the pressure chamber of the pressing cylinder, and a second, rear plunger rod having an operative pressure surface $A_{2.2}$ leading into the second rear cylinder pressure chamber, the multiplier plunger together with the two plunger rods, which have a common longitudinal axis, having a longitudinal bore containing a nonreturn valve;

a dual-circuit casting drive system for controlling a pressure medium which acts directly on the ram and which acts on the multiplier plunger;

wherein the dual-circuit casting drive system includes a valve control system which comprises quick-adjustment servo-proportional valves, wherein one of the quick-adjustment servo-proportional valve is provided in each case at least in an inlet/outlet to the pressing cylinder front pressure chamber in front of the ram and in an inlet/out of the first rear cylinder pressure chamber behind the multiplier plunger;

wherein displacement/speed measuring means are provided for measuring movements of the ram, and thus of the injection plunger, and movements of the multiplier plunger, and pressures in at least one of the pressing cylinder and the multiplier device pressure chambers;

wherein a computer is provided to control the valve control system servo-proportional valves in dependence on one another and in dependence on the movements of the ram and the multiplier plunger, and in dependence on pressures in the mold cavity, so that an injection operation during at least one of a prefilling phase, a mold filling phase, and a dwell phase is optimized by a controlled movement of the ram in conjunction with the movement of the multiplier plunger.

2. A pressure diecasting machine as claimed in claim 1, further comprising at least one further quick-adjustment servo-proportional valve, the at least one further quick-adjustment servo-proportional valve being disposed at least one of:

in front of the multiplier plunger in an inlet/outlet of the front cylinder pressure chamber of the multiplier cylinder casing; and in an inlet/outlet of the second rear cylinder pressure chamber for the rear plunger rod.

3. A pressure diecasting machine as claimed in claim 1, wherein the servo-proportional valve control system on the pressing cylinder and on the multiplier device brake the ram at the end of the mold filling phase by applying a counterpressure to the ram in the pressing cylinder front pressure chamber in order to minimize pressure peaks in the casting mold.

4. A pressure diecasting machine as claimed in claim 1, wherein the valve control system controls the multiplier device to brake the multiplier plunger or reversed movement of the multiplier plunger in order to minimize pressure peaks in the casting mold.

5. A pressure diecasting machine as claimed in claim 1, wherein the valve control system matches the movement of the ram and the movement of the multiplier plunger to one another within optimally short times of $t \leqq 0.5$ ms so that optimum dwell values are achieved in a third working phase.

6. A pressure diecasting machine as claimed in claim 1, wherein two pressure cushions are produced in at least one of the pressure chambers by the valve control system, wherein at least one of the ram and the multiplier plunger during movement is continuously clamped between the two pressure cushions whereby movements of at least one of the ram and the multiplier plunger is regulated within a regulation time of $t \leqq 5$ ms by means of the valve control system.

7. A pressure diecasting machine as claimed in claim 1, wherein the valve control system controls variation of the speed of at least one of the ram and the multiplier plunger within a timespan of $t \leqq 5$ ms.

8. A pressure diecasting machine, comprising:

a casting chamber for a metal bath;

an injection plunger movably disposed within the casting chamber;

a pressing cylinder having a pressure chamber, disposed behind the casting chamber and provided with a ram for driving the injection plunger, the pressure chamber being divided by the ram so that there is a front pressure chamber in front of the ram;

a multiplier device having a multiplier plunger, a closed multiplier cylinder casing divided into front and first and second rear cylinder pressure chambers by the multiplier plunger, disposed behind the pressing cylinder, the multiplier plunger being guided therein, the multiplier plunger including an operative rear, circular annular pressure surface $A_2$ in the closed multiplier cylinder casing, a first, front plunger rod having an operative front pressure surface $A_{2.1}$ leading into the pressure chamber of the pressing cylinder, and a second, rear plunger rod having an operative pressure surface $A_{2.2}$ leading into the second rear cylinder pressure chamber, the multiplier plunger together with the two plunger rods, which have a common longitudinal axis, having a longitudinal bore containing a nonreturn valve;

a dual-circuit casting drive system for controlling a pressure medium which acts directly on the ram and which acts on the multiplier plunger;

wherein the dual-circuit casting drive system includes a valve control system which comprises quick-adjustment servo-proportional valves, wherein one of the quick-adjustment servo-proportional valve is provided in each case at least in an inlet/outlet to the pressure chamber in front of the ram and in an inlet/out of the first rear cylinder pressure chamber behind the multiplier plunger;

wherein displacement/speed measuring means are provided for measuring movements of the ram, and thus of the injection plunger, and movements of the multiplier plunger, and pressures in at least one of the pressing cylinder and the multiplier device pressure chambers;

wherein a computer is provided to control the valve control system servo-proportional valves in dependence on one another and in dependence on the movements of the ram and the multiplier plunger, and in dependence on pressures in the mold cavity, so that an injection operation during at least one of a prefilling phase, a mold filling phase, and a dwell phase is optimized by a controlled movement of the ram in conjunction with the movement of the multiplier plunger;

wherein a ratio of plunger surface $A_{2.1}$ of the front plunger rod to plunger surface $A_{2.2}$ of the rear plunger rod is defined such that in forward movement of the multiplier plunger, the amount $m_1$ of the pressure medium flowing to the rear plunger rod in relation to the amount $m_2$ of the pressure medium displaced at the front plunger rod in the pressing cylinder pressure chamber is in the ratio of $m_1:m_2=0.8$ to 1.2:1.

9. A pressure diecasting machine, comprising:

a casting chamber for a metal bath;

an injection plunger movably disposed within the casting chamber;

a pressing cylinder having a pressure chamber, disposed behind the casting chamber and provided with a ram for driving the injection plunger, the pressure chamber being divided by the ram so that there is a front pressure chamber in front of the ram;

a multiplier device having a multiplier plunger, and a closed multiplier cylinder casing divided into front and first and second rear cylinder pressure chambers by the multiplier plunger, disposed behind the pressing cylinder, the multiplier plunger being guided therein;

a dual-circuit casting drive system for controlling a pressure medium which acts directly on the ram and which acts on the multiplier plunger;

wherein the dual-circuit casting drive system includes a valve control system which comprises quick-adjustment servo-proportional valves, wherein one of the quick-adjustment servo-proportional valve is provided in each case at least in an inlet/outlet to the front pressure chamber in front of the ram and in an inlet/outlet of the first rear cylinder pressure chamber behind the multiplier plunger;

wherein displacement/speed measuring means are provided for measuring movements of the ram, and thus of the injection plunger, and movements of the multiplier plunger, and pressures in at least one of the pressing cylinder and the multiplier device pressure chambers;

wherein a computer is provided to control the valve control system servo-proportional valves in dependence on one another and in dependence on the movements of the ram and the multiplier plunger, and in dependence on pressures in the mold cavity, so that an injection operation during at least one of a prefilling phase, a mold filling phase, and a dwell phase is optimized by a controlled movement of the ram in conjunction with the movement of the multiplier plunger; and wherein an operative pressure surface $A_1$ of the ram in the pressing cylinder pressure chamber in relation to a difference in area of the multiplier circular annular surface A in the first rear cylinder pressure chamber of the multiplier cylinder plus the operative pressure surface $A_{2.2}$ of the rear plunger rod in the second rear cylinder pressure chamber is in the ratio of $A_1:(A_2+A_{2.2})=1:(2.5$ to $4)$.

10. An apparatus comprising:

casting equipment including an injection plunger rod;

a casting drive system disposed behind the casting equipment and including:

a pressing cylinder provided with a ram and, a multiplier device provided with a multiplier plunger;

wherein the casting drive system is a two-circuit casting apparatus including a valve control system which controls quick-adjustment servo-proportional valves having a regulation time of $t \leqq 5$ ms;

wherein at least an inlet/outlet of the pressing cylinder and an inlet/outlet of the multiplier device are provided with respective ones of the quick-adjustment servo-proportional valves;

wherein all the movements of the injection plunger rod and the multiplier plunger are detectable by measuring means for measuring displacement and speed;

wherein a computer is provided to control the servo-proportional valves in dependence on movements of the injection plunger rod and of the multiplier plunger;

wherein the multiplier device multiplier plunger has a front plunger rod connected thereto;

wherein the multiplier device includes a rear plunger rod, a central longitudinal bore containing a nonreturn valve, a front pressure chamber and a rear pressure chamber; and wherein the front and rear pressure chambers are regulated by ones of the servo-proportional valves to clamp the multiplier plunger.

11. An apparatus as claimed in claim 9, wherein the second rear cylinder pressure chamber lying behind the rear plunger rod of the multiplier plunger is regulated by the valve control system.

12. An apparatus as claimed in claim 9, further comprising measuring transducers, wherein respective pressures in the pressure chambers are detected and signals representing the pressures are transmitted to the computer by the measuring transducers for enabling the computer to control the valve control system to clamp the ram and the multiplier plunger respectively.

13. A method of controlling a pressure diecasting machine having at least an injection plunger, a pressing chamber with a ram therein for driving the injection plunger, at least two quick-adjustment servo-proportional valves communicating with portions of the pressing chamber at opposite ends of the ram, a valve control system for controlling the valves, step and speed measuring devices, and a processor for receiving signals from the measuring devices and controlling the valve control system, the method comprising:

determining a state of operation of the pressure diecasting machine with the processor based on signals from the step and speed measuring devices; and controlling a pressure medium in the pressing chamber with processor through the valve control system during forward motion of the ram so that controllable pressure and counter-pressure is applied to the ram.

14. The method of claim 13, wherein the diecasting machine further has a multiplier device having a multiplier chamber and a multiplier plunger, and further quick-adjustment servo-proportional valves controlled by the valve control system, the further valves communicating with the multiplier chamber, and wherein the method further comprises:

activating the multiplier plunger, independently of the ram, with the processor and the valve control system through the further valves, based on a determined state of operation of the pressure diecasting machine.

* * * * *